United States Patent [19]

Schuelein et al.

[11] Patent Number: 4,745,781

[45] Date of Patent: May 24, 1988

[54] ASSEMBLY OF TIGHTLY ADJACENT EYE NEEDLES

[75] Inventors: Fritz Schuelein, Treuchtlingen; Johann Berger, Obere Schloss-Strasse 114, D-7071 Alfdorf; Josef Berger, Hainstrasse 11, D-7070 Schwaebisch-Gmeund-Grossdeinbach, all of Fed. Rep. of Germany

[73] Assignees: Johann Berger, Alfdorf; Josef Berger, Schwaebisch-Gmuend-Grossdeinbach, both of Fed. Rep. of Germany

[21] Appl. No.: 66,713

[22] Filed: Jun. 26, 1987

[30] Foreign Application Priority Data

Nov. 3, 1986 [DE] Fed. Rep. of Germany ..... 3637328

[51] Int. Cl.[4] ..... D04B 27/02

[52] U.S. Cl. ..... 66/214; 66/207

[58] Field of Search ..... 66/203, 214, 207

[56] References Cited

U.S. PATENT DOCUMENTS 3,044,283 7/1962 Liebchen ..... 66/214
3,099,921 8/1963 Liebrant ..... 66/214

FOREIGN PATENT DOCUMENTS 1030784 5/1966 United Kingdom ..... 66/214
1085643 10/1967 United Kingdom ..... 66/214

*Primary Examiner*—Ronald Feldbaum
*Attorney, Agent, or Firm*—Gilbert L. Wells

[57] ABSTRACT

The invention concerns an assembly of sets of tightly adjacent eye needles (12) for filling-yarn knitting machinery. One set each of eye needles (12) is anchored by injection-molding in supports (8,9) at mutually equidistant positions, the needles being mutually parallel by their main planes. Two supports (8,9) each with a set of eye needles (12) form one segment of eye needles. The heads (22) of the eye needles (12) of the first set (24) of needles alternatingly enter centrally between every two heads of the eye needles of the second set (25) of needles. The two sets of needles are fixed within the segments and are oblique in such a manner that a conceptual plane from one of the sets (24) of needles (plane (5) of the set) extending along the eye needles and through the heads of this set of needles intersects the plane (5') of the set of the other needle-set (25) in the region of the heads. As a result, very fine ribbons or tapes may be manufactured that require minute separations between the heads of the eye needles, while eye needles having comparatively thick stems nevertheless can be used and these stems furthermore can be anchored by injection-molding them in each support. A segment of eye needles also can be formed by more than two mutually oblique sets (24,26,26) of needles.

11 Claims, 1 Drawing Sheet

ASSEMBLY OF TIGHTLY ADJACENT EYE NEEDLES

The invention concerns an assembly of tightly adjacent eye needles useful in a knitting machine.

BACKGROUND OF THE INVENTION

It is accordingly known, in particular as regards filling-yarn knitting but also in a galloon crocheting machines, to mount eye needles in the form of so-called segments, each segment containing a row of eye needles in a metal or plastic support and housed parallel to each other by their main planes and in a mutually equidistant manner. As a rule the eye needles are used to feed warp-yarns when making ribbons or tapes, especially elastic ones.

A need exists for bands or ribbons containing more than 10 or 12 warps, and possibly also with many elastic filaments per centimeter of machine width. This means that the eye needles must be case or injection-molded in an increasingly denser manner into a support. If for instance 12 needles must be housed per cm of machine width, there will be a needle every 0.83 mm. In conventional eye needles, the stem already approximately assumes this width, and accordingly no space is left in which to pour the casting material, namely a light-alloy or plastic, to anchor the needle stems.

Therefore very small and thin needles are used for high yarn densities. The strength of such needles is however inadequate. They bend, and thereby on occasion warps are placed into the wrong knitting needle heads. Furthermore, thin eye needles wear comparatively rapidly.

By means of the present invention it is possible to use eye needles having a thickness near the eye of only about 0.3 mm while simultaneously having rugged and comparatively thick stems. At the same time, a needle density of 12 and more per centimeter of machine width is possible.

SUMMARY OF THE INVENTION

This problem is solved in an assembly of sets of tightly adjacent eye needles of a knitting machine, in particular a filling-yarn knitting machine, wherein in each support one set of eye needles is anchored with the needles being equidistant in such a manner that they are mutually parallel by their main planes, in such a way as to form an eye needle segment (segment), two supports are used each with one group of eye needles (sets of needles).

the heads of the eye needles of the first set of needles penetrate centrally between each two heads of the eye needles of the second set of needles and the heads of the two sets of needles alternate in the direction of the common row of heads.

the two sets of needles are mounted within the segment in a fixed and in a particular oblique manner whereby a conceptual plane of one of the set of needles (plane of the set) extending along the eye needles and through the heads of this set of needles intersects the plane of the set of the other needles in the region of the heads.

In the invention therefore the heads of two sets of needles which are individually cast, especially injection-molded, will alternate. As a result twice the needle density of previous needle segments can be achieved using comparatively big eye needles of the state of the art. This is made possible by two sets of needles being mounted mutually obliquely in such a manner that the heads of the eye needles penetrate through each other. The eyes of both sets of eye needles may be flush with each other. However this is not mandatory. A mutual offset of the heads of both sets in the direction of the head planes is permissible. What is essential is that the lateral spacings between head and head in the direction of the common row of heads be as equal as is allowed within the achievable precision because only very little space remains to pass the warps and the danger of placing warps into the wrong knitting needles must be minimized.

The mutual penetration of the heads is achieved by screwing conventional eye needle supports from both sides on a drive shaft of the machine. Thereby the two planes of sets of needles subtend a relatively large but still acute angle.

In one embodiment of the present invention more than two, in particular three supports each with one set of needles can form one segment, whereby it is possible to use eye needles with especially wide stems and nevertheless achieve high yarn density.

Conventional supports for each set of eye needles can be brazed together, which is convenient in the case of metal supports and especially in the case of light-alloy supports. If the supports are plastic, they can be fused or bonded together.

Lastly the supports for sets of eye needles can be cast into a common block, such as by injection-molding. This is preferable in the case of large production runs and high accuracy.

BRIEF DESCRIPTION OF THE DRAWINGS

Illustrative embodiments with further features of the invention are described below in relation to the drawings wherein.

DESCRIPTION OF PREFERRED EMBODIMENTS

Figure 1:
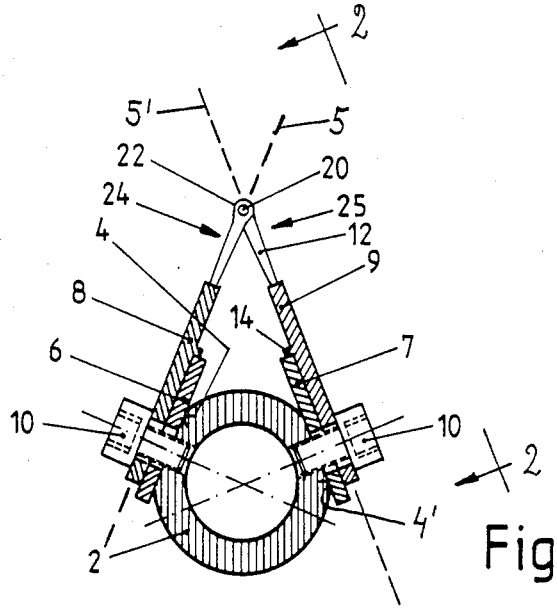
FIG. 1 is a cross-section of a drive-shaft of a filling-yarn knitting machine with eye needle supports screwed on both sides of the shaft.
Figure 2:
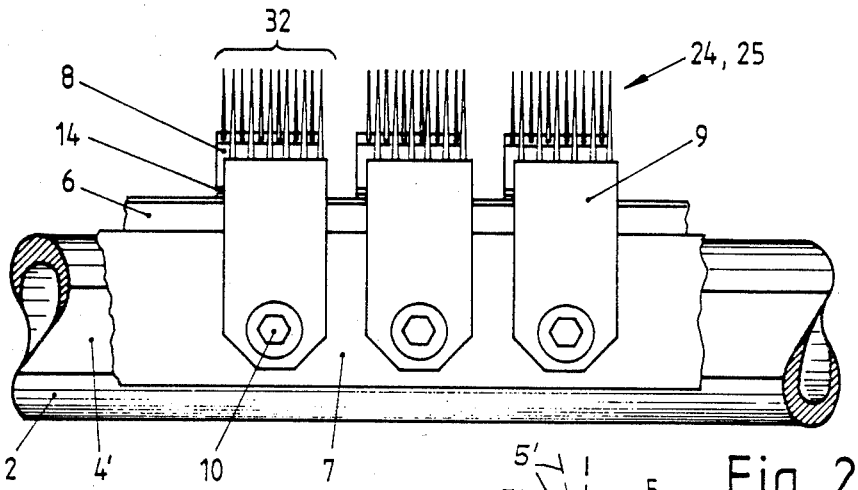
FIG. 2 is a sideview taken along line 2—2 of FIG. 1, showing part of the drive-shaft with three supports mounted one each side.

FIGS. 1 and 2 show a drive-shaft 2 extending in typical fashion across the width of the filling-yarn knitting machine and being rotatable to-and-fro. Plane surfaces 4,4' are milled on both sides of the drive-shaft 2 along its length. The two surfaces 4,4' subtend between them an angle illustratively of 45°. Spacer places 6,7 rest respectively against the surfaces 4,4' and also extend across the width of the machine. As shown in FIG. 2, three supports 8,9 each with a set of six eye needles such as the needle 12 are screw-mounted on each side. In most cases there will be many more supports mounted next to one another. Each may comprise more than six, for instance eighteen eye needles. Two planes of needle sets denoted by 5 and 5' extend along the eye needles 12 through the heads 22 of both sets of needles and intersect in the region of the heads.

One hexagonal set-screw 10 each passes through one hole of each support 8,9 and the spacer plates 6,7 and is threaded in a bore of the drive-shaft 2. The supports 8,9 each are provided with a rest strip 14 supported by the upper edge of the associated spacer plate 6,7 in FIG. 1 and to secure against rotation. The two supports 8,9 together with their eye needles 12 form a common segment cooperating in the machine with a set of knitting needles.

Each support 8,9 is a cast metal body, in particular a light-alloy, or a plastic body, and keeps the stems of the eye nedles 12 in place at equidistant mutual positions with mutually parallel needle-planes and with mutually flush eyes 20. In a manner known per se, the eye-equipped heads of the eye needles are substantially thinner than the stems whereby there is enough space between every two heads to insert a head from a second set of needles and further there remains enough space for the warps passing through the eyes 20.

Each head of the set of needles 24 shown on the left in FIG. 1 penetrates between two heads of the set of needles 25 of FIG. 1 and with the highest possible accuracy centrally between the two heads. FIG. 1 shows that the eyes 20 of the heads of both sets of needles are aligned with each other. However this is an idealized condition which need not be obtained in practice for effective operation. It is enough that the heads mutually overlap, while the eyes 20 of both sets of needles may be somewhat offset from each other.

Figure 3:
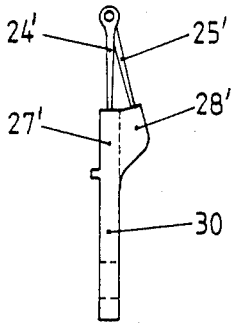
FIG. 3 is a sideview of an alternative embodiment containing two supports each with one set of eye needles.

FIG. 3 shows another embodiment of the present invention wherein two sets 24' and 25' of needles are anchored in supports 27' and 28' respectively and where both supports 27', 28' are mounted on a common sinker 30. The two sets of needles in this case subtend a much smaller angle than in FIG. 1. Illustratively the angle may be 11°.

If an injection-molding apparatus is correspondingly designed, both supports 27', 28' can be injection-molded integrally. For a simpler design, the supports 27', 28' can be injection-molded individually and where made of metal can be brazed together. If the supports are made of plastics material they can be welded together or cemented together if thereby the necessary solidity and durability can be achieved.

Segments shown in FIG. 3 are also mounted on a drive-shaft such as the shaft 2, but only on one side thereof.

Figure 4:
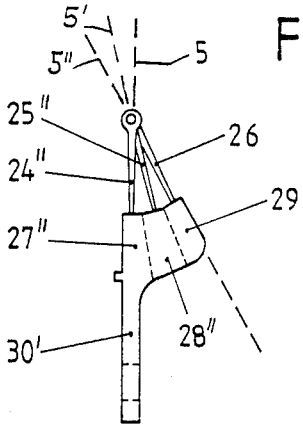
FIG. 4 is a sideview of still another alternative embodiment containing three supports each with one set of eye needles.

FIG. 4 shows a further embodiment of the present invention having three supports 27'', 28'', 29 for three sets of needles 24'', 25'', 26. The supports are combined in one of the above described ways. All three supports are mounted on a common sinker 30'. Seen in the direction of the row of heads, that is transversely to the plane of the drawing of FIG. 4, the heads of the needles 24'', 25'', 26 follow one another.

We claim:

1. Assembly holding mutually tightly adjacent eye needles of a knitting machine, wherein:

(a) a set of eye needles is anchored in such a manner in a support and in mutually equidistant positions in a casting such that the needles are mutually parallel in their main planes; and (b) a plurality of supports, at least three in number (27,28,29) each with one set of eye needles (sets of needles 24,25,26) forming one segment of eye needles; and (c) heads of the eye needles from the second to the last set of needles (25,26) enter between every two heads of the first set of needles (24) and the heads of all sets of needles mutually alternate in the direction of the common row of heads while being essentially mutually equidistant; and (d) all sets of needles are mounted in fixed manner within the segment and obliquely in such a way that (e) a conceptual plane 5 of one of the sets of needles extending along the eye needles and through the heads of this set of needles intersects in the region of the heads with the planes 5', 5'' of the other sets of needles.

2. Assembly of claim 1, characterized in that the supports are brazed to each other.

3. Assembly of claim 1, characterized in that the supports are welded to each other.

4. Assembly of claim 1, characterized in that the supports are cemented to each other.

5. Assembly of claim 1, characterized in that the supports are cast into an integral block.

6. An assembly of a plurality of sets of tightly adjacent eye needles in a knitting machine, comprising:

(a) a first set of eye needles anchored in a first support in mutually equidistant positions so that said needles are mutually parallel in their main planes;

(b) a second set of eye needles anchored in a second support in mutually equidistant positions so that said needles are mutually parallel in their main planes;

(c) said first and second supports mounted in proximity to one another and directing said first and second needles into alignment defining a first segment of eye needles;

(d) said first and second sets of eye needles having heads and said heads of said first set located centrally between every two heads of said second set and the heads of said first and second sets mutually alternate in the direction of a common row of heads; and (e) said first and second sets mounted within said segment in fixed manner and obliquely such that (f) a first plane is defined by said first set extending along said eye needles and through said heads of said first set of needles, a second plane of said second set of needles intersects said first plane in a region of said heads.

7. Assembly of claim 6, wherein said first and second supports are screwed into approximately opposite lateral surfaces of a drive-shaft of a knitting machine.

8. Assembly of claim 6, wherein said supports are brazed to each other.

9. Assembly of claim 6, wherein said supports are welded to each other.

10. Assembly of claim 6, wherein said supports are cemented to each other.

11. Assembly of claim 6, wherein said supports are cast into an integral block.

* * * * *